US011134352B2

(12) United States Patent
Kröni et al.

(10) Patent No.: US 11,134,352 B2
(45) Date of Patent: Sep. 28, 2021

(54) HEARING DEVICE WITH WAX GUARD INTERFACE

(71) Applicant: Sonova AG, Stäfa (CH)

(72) Inventors: Valerie Mena Kröni, Küsnacht (CH); Heinz-Thomas Winkler, Stäfa (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/776,241

(22) Filed: Jan. 29, 2020

(65) Prior Publication Data

US 2021/0235210 A1 Jul. 29, 2021

(51) Int. Cl.
*H04R 25/00* (2006.01)

(52) U.S. Cl.
CPC ..... *H04R 25/654* (2013.01); *H04R 25/602* (2013.01); *H04R 25/604* (2013.01); *H04R 2225/025* (2013.01)

(58) Field of Classification Search
CPC ..... H04R 2460/17
USPC ..... 381/325
See application file for complete search history.

(56) References Cited

U.S. PATENT DOCUMENTS 3,061,689 A 10/1962 McCarrell et al.
3,197,577 A * 7/1965 Kuklock ..... H04R 25/654 381/325
3,414,685 A 12/1968 Geib et al.
4,870,689 A 9/1989 Weiss
4,879,750 A * 11/1989 Nassler ..... H04R 25/654 381/325
4,880,076 A 11/1989 Ahlberg et al.
4,937,876 A 6/1990 Biermans
4,957,478 A 9/1990 Maniglia
4,987,597 A 1/1991 Haertl
5,002,151 A 3/1991 Oliveira
5,015,224 A 5/1991 Maniglia
5,390,254 A 2/1995 Adelman
5,654,530 A 8/1997 Sauer
5,682,020 A 10/1997 Oliveira
5,701,348 A 12/1997 Shennib et al.
5,712,918 A 1/1998 Yoest
5,742,692 A 4/1998 Garcia et al.
5,864,628 A 1/1999 Posen et al.
5,970,157 A 10/1999 Yoest
6,134,333 A 10/2000 Hagler
6,208,741 B1 3/2001 Shennib et al.
6,212,283 B1 4/2001 Fletcher et al.
6,600,825 B1 * 7/2003 Leysieffer ..... H04R 25/60 381/328
6,795,562 B1 * 9/2004 Gunnersen ..... H04R 25/654 381/325
7,313,245 B1 12/2007 Shennib
7,876,919 B2 1/2011 Ram et al.
(Continued)

FOREIGN PATENT DOCUMENTS

WO WO 9709864 A1 3/1997
WO WO 2008/080397 A1 7/2008
(Continued)

*Primary Examiner* — Suhan Ni
(74) *Attorney, Agent, or Firm* — Henricks Slavin LLP

(57) ABSTRACT

An apparatus with a hearing device housing including at least one wall with a sound aperture and a counterbore around the sound aperture, and a bushing, having a portion thereof located within the counterbore and secured thereto, configured to receive a hearing device cerumen guard.

12 Claims, 5 Drawing Sheets

(56) References Cited

U.S. PATENT DOCUMENTS

| | | | | |
|---|---|---|---|---|
| 8,295,522 | B2 | 10/2012 | Vestergaard et al. | |
| 8,457,336 | B2 | 6/2013 | Ladabaum et al. | |
| 8,494,200 | B2 | 7/2013 | Ram et al. | |
| 9,392,385 | B2 | 7/2016 | Nielsen et al. | |
| 9,820,062 | B2 | 11/2017 | Stewart | |
| 2003/0198360 | A1 | 10/2003 | Niederdrank | |
| 2006/0256990 | A1 | 11/2006 | Holmes | |
| 2012/0163643 | A1 | 6/2012 | Vestergaard et al. | |
| 2018/0227686 | A1* | 8/2018 | Frei ..... | H04R 25/652 |

FOREIGN PATENT DOCUMENTS

| | | | |
|---|---|---|---|
| WO | WO 2013/091682 | A1 | 6/2013 |
| WO | WO 2018/153458 | A1 | 8/2018 |

* cited by examiner

HEARING DEVICE WITH WAX GUARD INTERFACE

BACKGROUND

1. Field

The present inventions relate generally to hearing devices and, for example, hearing devices that are worn in the ear canal or that include a component that is worn in the ear canal.

2. Description of the Related Art

Many hearing devices (or portions thereof) are located within the ear canal. In-the-ear ("ITE") hearing device, for example, typically include a housing that is positioned within the ear canal and a receiver that located within the housing. The housing has a sound output port that is positioned adjacent to the tympanic membrane and connected to the receiver output port. Other hearing device components (e.g., the microphone, electronics and battery) may, for example, be located with the housing or within a faceplate mounted onto the end of the housing opposite the sound port. Behind-the-ear ("BTE") hearing devices, on the other hand, typically include a BTE component, with the microphone, electronics, and battery, and an ITE component that delivers sound to ear canal. The ITE component may include a receiver assembly, with a receiver and a receiver housing, and a soft earpiece that is mounted on the medial end of the receiver assembly to center the receiver relative to the ear canal with the sound output port of the receiver housing facing the tympanic membrane.

One issue associated with ITE hearing devices and the ITE components of BTE hearings devices is the risk of cerumen, which is commonly referred to as ear wax, clogging the sound output port within the ear canal. One proposed solution is to mount a replaceable wax guard over the sound output port. A plastic bushing is secured to the hearing device housing at the sound output port with an adhesive, and the wax guard is mounted to the bushing and over the sound output port. The plastic bushing includes a tube and a flange, with a top surface and a bottom (or "abutment") surface, that extends outwardly from the tube. In the conventional arrangement, the abutment surface of the bushing flange is secured to the outermost surface of the exterior of the hearing device housing with adhesive. The bushing is intended to be a permanent part of the associated hearing device (i.e., a part that is not removable under normal operation), while the wax guard is intended to be a removable and replaceable part of the associated hearing device.

Although conventional bushing and wax guard arrangements have proven useful, the present inventor has determined that they are susceptible to improvement. For example, the present inventor has determined that the conventional method of securing the plastic bushing to the hearing device housing results in an unacceptably high rate of the bushing/housing separations. The separation issue is especially acute in those instances where the plastic bushing is secured to a titanium housing for at least two reasons. First, the adhesive bond between titanium and plastic weakens over time. Second, positioning the bushing flange on the outermost exterior surface of the hearing device housing exposes the bushing flange to forces that can dislodge the bushing, e.g., the force associated with a fingernail wedging between the bushing flange and the exterior surface of the hearing device housing during a cleaning procedure.

SUMMARY

An apparatus in accordance with one embodiment of a present invention has a hearing device housing including at least one wall with a sound aperture and a counterbore around the sound aperture, and a bushing, having a portion thereof located within the counterbore and secured thereto, configured to receive a hearing device cerumen guard. The present inventions also include hearing devices with such an apparatus.

There are a number of advantages associated with such a hearing devices and systems. By way of example, but not limitation, placement of the bushing within the counterbore reduces the likelihood that a fingernail or other object can wedge itself between the bushing flange and the housing or that a lateral force can be applied to the bushing flange. As such, even in those instances where adhesive or other instrumentality that secures the bushing to the housing is in a weakened state, the bushing is less likely to be dislodged from the hearing device housing.

The many features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

DETAILED DESCRIPTION OF EXEMPLARY EMBODIMENTS

Figure 1:
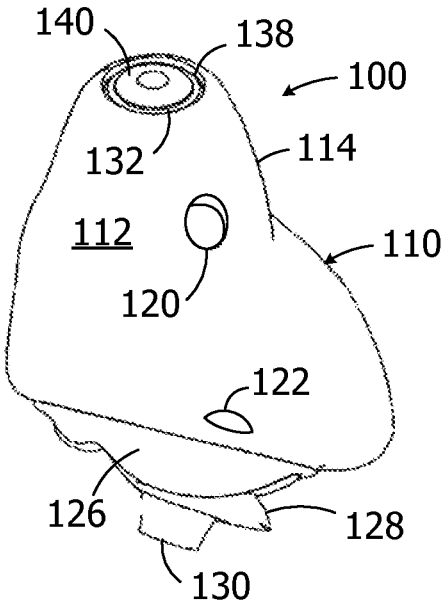
FIG. 1 is a perspective view of a hearing device in accordance with one embodiment of a present invention.
Figure 2:
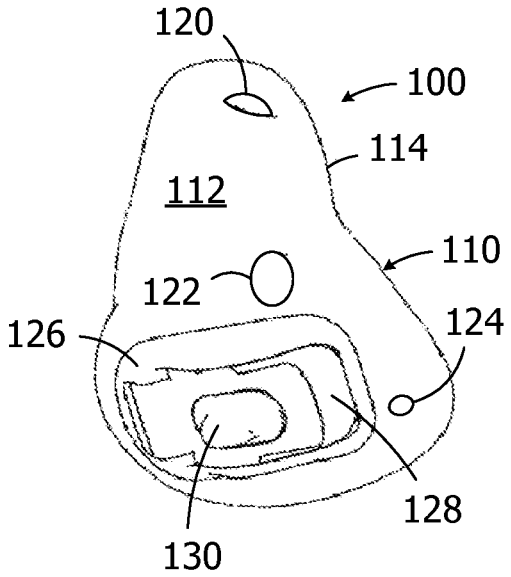
FIG. 2 is another perspective view of the hearing device illustrated in FIG. 1.
Figure 3:
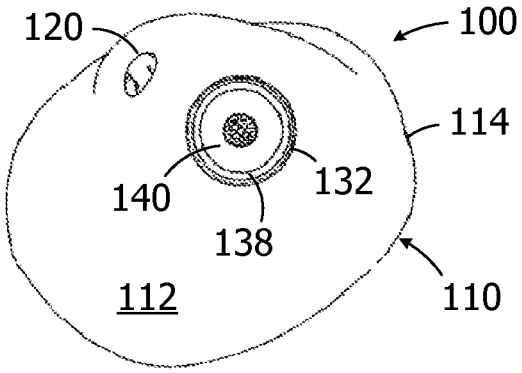
FIG. 3 is an end view of the hearing device illustrated in FIG. 1.

The following is a detailed description of the best presently known modes of carrying out the inventions. This description is not to be taken in a limiting sense, but is made merely for the purpose of illustrating the general principles of the inventions.

As illustrated in FIGS. 1-5, an exemplary in-the-ear (ITE) hearing device 100 includes a microphone 102, a receiver 104, a battery or other power supply 106, and sound processing electronics 108 that are located within a housing 110. The exemplary housing 110, which is sized and shaped for positioning within the ear canal, includes a wall 112 with an outermost surface 114, a sound output aperture 116 that defined by a side surface 118 as well as a venting aperture 120, a venting aperture 122, a handle aperture 124 for a removable handle (not shown). The shape of the housing 110 may be a generic shape that is suitable for a large number of patients or may be a custom shape that is 3D printed or otherwise formed for the ear canal of a particular patient. Suitable housing materials include, but are not limited to, plastics such as an acrylic and metals such as titanium. The exemplary hearing deice 100 also includes a housing cover 126 at the lateral end of the housing 110. The battery 106 may be stored at or within housing cover 126 and, to that end, the exemplary housing cover includes a pivotable battery door 128. A push button 130, which may perform various function, may also be provided.

Figure 4:
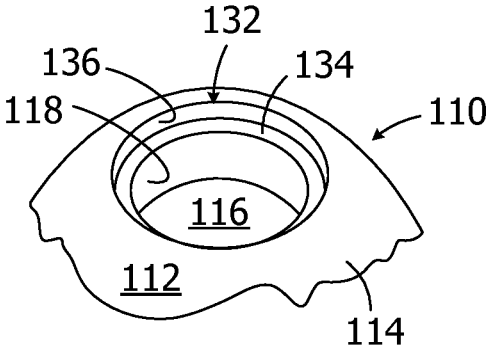
FIG. 4 is a perspective view of a portion of the hearing device illustrated in FIG. 1.
Figure 5:
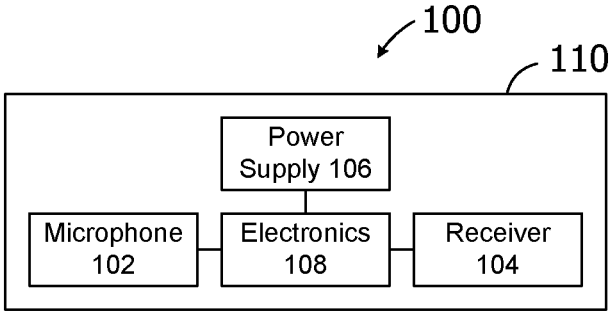
FIG. 5 is block diagram of the hearing device illustrated in FIG. 1.

Referring more specifically to FIG. 4, the exemplary housing wall 112 includes a counterbore 132 located around the sound output aperture 116. The counterbore 132, which is discussed in greater detail below with reference to FIGS. 6-10, includes an abutment surface 134 and a side surface 136 that extends from the abutment surface to the outermost surface 114 of the housing wall 112. The exemplary ITE hearing device 100 also includes a bushing 138 that is positioned within the counterbore 132 and permanently secured to the housing 110, as well as a wax guard 140 that may be removably mounted to the bushing. As used herein, a bushing is permanently secured (or "connected") to a housing when, once connected, the bushing will remain on the housing under normal use conditions, and cannot be removed from the housing without destruction of the bushing, the housing and/or the adhesive bond (or other instrumentality) connecting the two. It should also be noted here that, in those instances where a titanium housing is formed using a 3D printing process, the surfaces of the counterbore 132 may require post-printing machining to smooth out any rough surfaces.

Figure 6:
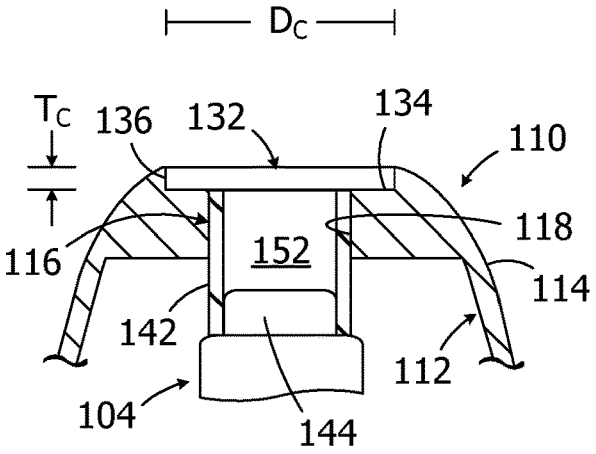
FIG. 6 is a partial section view of a portion of the hearing device illustrated in FIG. 1.

As illustrated for example in FIG. 6, a sound tube 142 may be used to direct sound from the receiver 104 to the sound output aperture 116 of the housing 110. In the illustrated implementation, the sound tube 142 is mounted on the receiver output port 144 and may be secured to the housing 110 and, in particular, may be secured to the side surface 118 that defines the sound aperture 116, with adhesive (not shown) or some other suitable instrumentality (not shown). Should any of the sound tube 142 extend into the counterbore 132 after the sound tube is secured to the housing 110, that portion of the sound may be removed so that the end of the sound tube is flush with the counterbore abutment surface 134.

Figure 7:
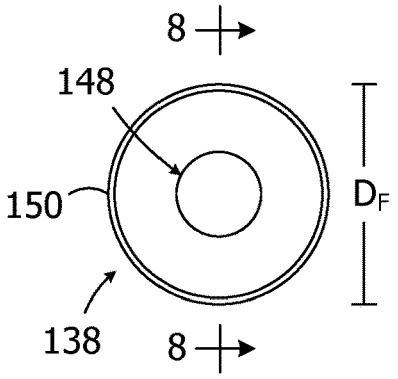
FIG. 7 is a plan view of a portion of the hearing device illustrated in FIG. 1.
Figure 8:
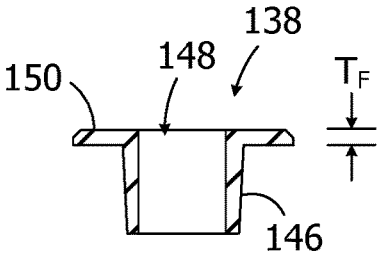
FIG. 8 is a section view taken along line 8-8 in FIG. 7.

Turning to FIGS. 7 and 8, the exemplary bushing 138 includes a tube 146, with a lumen 148, and a flange 150 that extends radially outwardly from the tube. The bushing 138 is also configured to fit within the counterbore 132. As such, the flange outer diameter $D_F$ may be either less than (as shown) or equal to counterbore diameter $D_C$ (FIG. 6). The flange thickness $T_F$ may be either less than (as shown), equal to or slightly greater than the counterbore thickness $T_C$ (FIG. 6).

Figure 9:
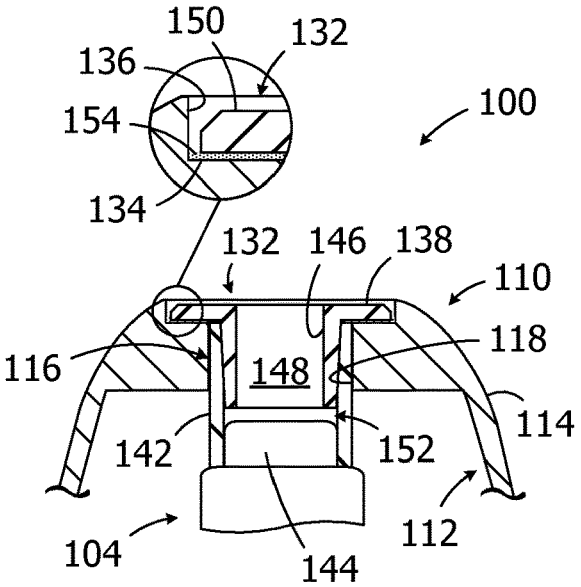
FIG. 9 is a partial section view of a portion of the hearing device illustrated in FIG. 1.
Figure 10:
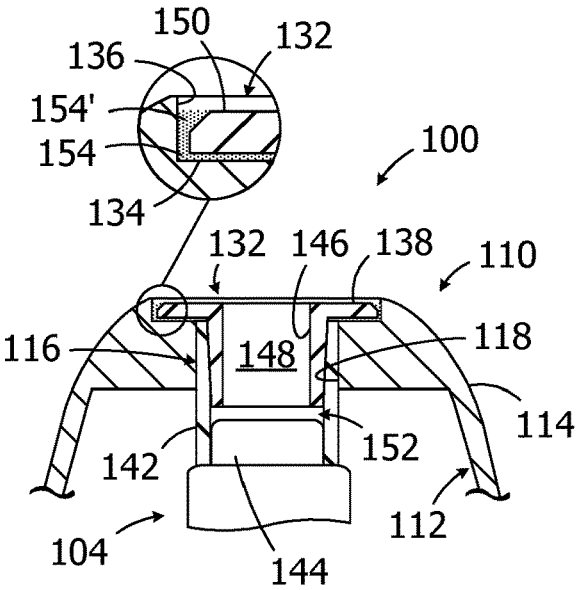
FIG. 10 is a partial section view of a portion of the hearing device illustrated in FIG. 1 with additional adhesive.
Figure 10A:
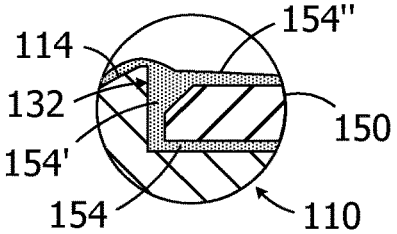
FIG. 10A is a partial section view of a portion of the hearing device illustrated in FIG. 1 with additional adhesive.
Figure 14:
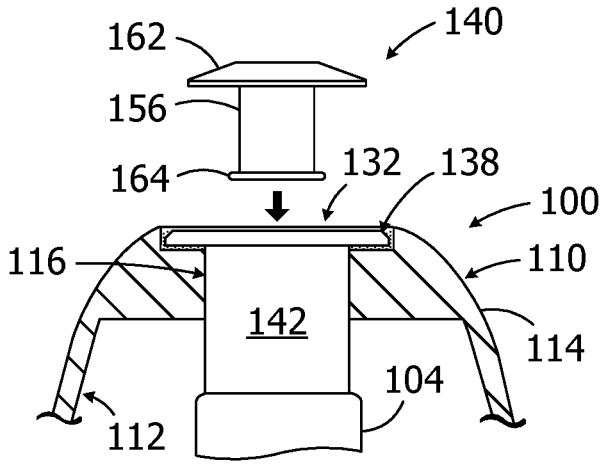
FIG. 14 is an exploded partial section view of a portion of the hearing device illustrated in FIG. 1.
Figure 15:
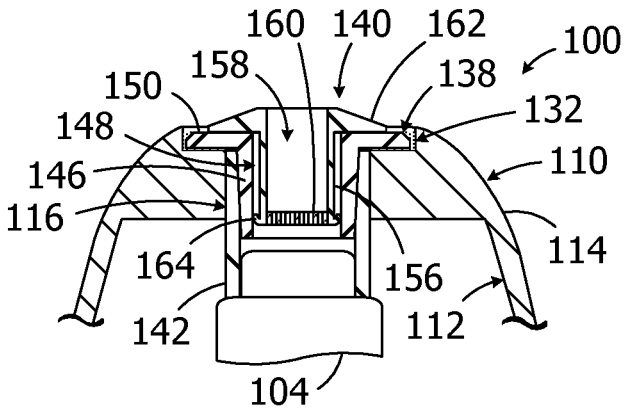
FIG. 15 is a partial section view of a portion of the hearing device illustrated in FIG. 1.

The bushing 138 may be permanently secured to the housing 110 and, more specifically, may be permanently secured to the housing wall 112 at the medial end of the housing and within the counterbore 132 in the exemplary manner illustrated in FIG. 9. The bushing lumen 148 is within the sound tube lumen 152, thereby enabling the wax filter 140 to be aligned with the sound tube 142 when the wax filter is mounted to the housing 110 in the manner discussed below with reference to FIGS. 14 and 15. An adhesive 154 is deposited onto the counterbore abutment surface 134 and the bushing flange 150 is placed onto the adhesive, thereby permanently connecting the bushing 138 to the housing 110. The bushing tube 146 extends into the sound tube lumen 152. Suitable adhesives include, but are not limited to, a biocompatible UV curing adhesive, a biocompatible instant adhesive, or any suitable glue. Additionally, in those instances where the flange outer diameter DF is less than the counterbore diameter Dc (as in the illustrated embodiment), a small gap may remain between the outer perimeter of the bushing flange 150 counterbore side surface 136. This gap may be filled with additional adhesive 154', as shown in FIG. 10. Turning to FIG. 10A, additional adhesive 154" may also be deposited onto the top of the bushing flange 150 and a portion of the housing wall outermost surface 114. The additional adhesive 154' and 154" may be the same as, or different than, the adhesive 154. The additional adhesive 154' and 154" may also be Loctite 4310 or a suitable biocompatible coating.

Figure 11:
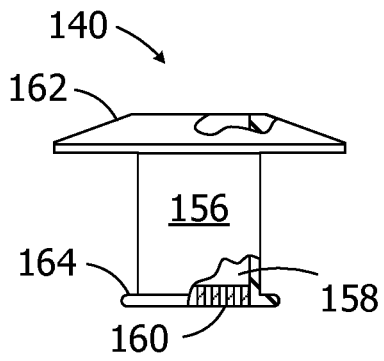
FIG. 11 is a side, cutaway view of a wax guard.
Figure 12:
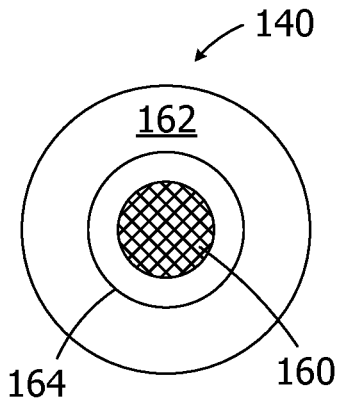
FIG. 12 is an end view of the wax guard illustrated in FIG. 11.
Figure 13:
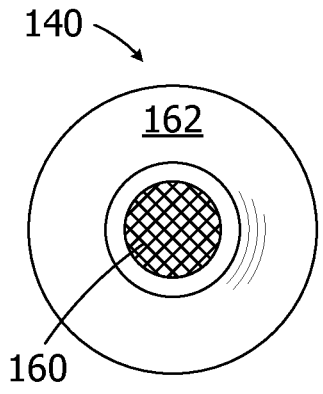
FIG. 13 is another end view of the wax guard illustrated in FIG. 11.

Referring to FIGS. 11-13, and although the present inventions are not limited to use with any particular wax guards, the exemplary wax guard 140 includes a tube 156 with an internal lumen 158. The tube 156 is open at one end, while a wax filter 160, which prevents cerumen from passing through the lumen 158, is located at the other end. The wax guard 140 also include a flange 162 at the open end of the tube 156 and a small projection 164 at the end of the tube with the wax filter 160. The wax guard 140 may be secured to the housing 110 by way of the bushing 138 in, for example, the manner illustrated in FIGS. 14 and 15. After being positioned adjacent to the bushing 138, with the wax guard tube 156 aligned with the bushing lumen 148, the wax guard 140 may be pushed into the bushing lumen. The outer diameter of the wax guard projection 164 is slightly greater than the diameter of the bushing lumen 148. As a result, the wax guard projection 164 will deflect and/or a portion of the bushing tube 146 will be indented when the wax guard projection enters the bushing lumen 148. This creates an interference fit that secures the wax guard 140 to the housing 110 during use, yet allows the wax guard to be removed and replaced as necessary.

There are a variety of advantages associated with the present configuration. By way of example, placement of the bushing 138 with the counterbore 132 results in the bushing/ housing interface being below the outermost surface 114 of the associated housing wall 112 (or otherwise offset from the outermost surface depending upon the orientation of the hearing device). Such positioning reduces the likelihood that an object, such as a fingernail or a cleaning cloth, moving along the outermost surface 114 of the housing wall 112 will wedge itself under, or simply apply a lateral force to the bushing flange 150. This, in turn, reduces the likelihood that the bushing 138 will be dislodged from the hearing device housing 110. The likelihood of dislodging is further reduced through the use of adhesive 154' around the perimeter of the bushing flange 150 and/or the adhesive 154" over the top surface of the bushing flange.

Figure 16:
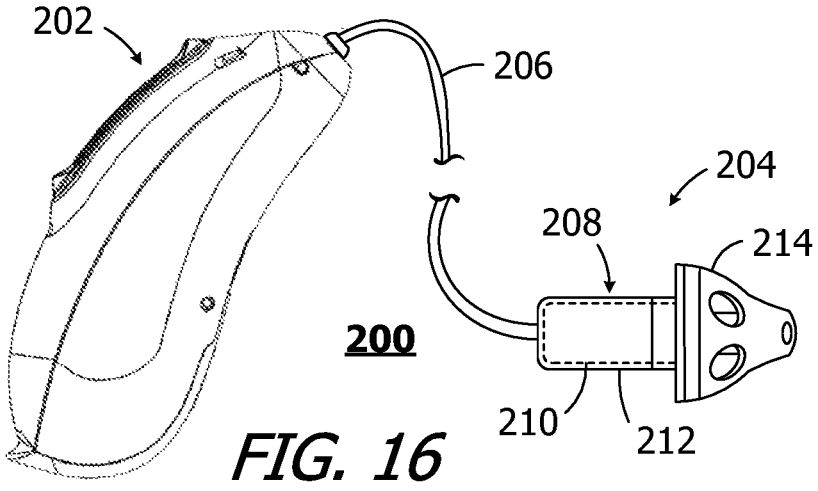
FIG. 16 is a side view of a hearing device in accordance with one embodiment of a present invention.
Figure 17:
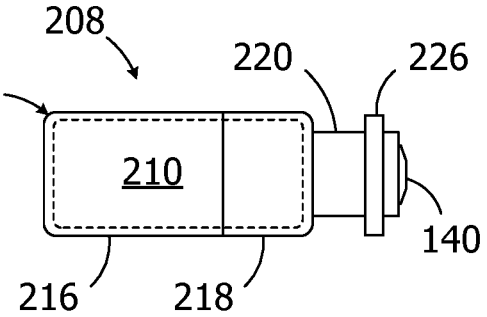
FIG. 17 is a side view of a portion of the hearing device illustrated in FIG. 16.
Figure 18:
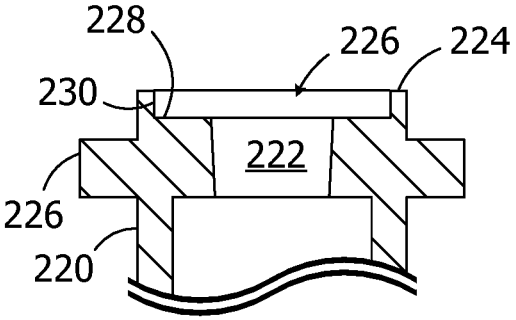
FIG. 18 is a section view of a portion of the hearing device illustrated in FIG. 16.

Another exemplary hearing device is generally represented by reference numeral 200 in FIG. 16. The exemplary hearing device 200 includes a behind-the-ear (BTE) component 202, with one or more microphones, a sound processor, a power source and other conventional instrumentalities, and an in-the-ear (ITE) component 204 that delivers sound to ear canal. A cable 206 electrically connects the BTE component 202 to the ITE component 204. The exemplary ITE component 204 includes a receiver assembly 208, with a receiver 210 and a receiver housing 212, and a soft earpiece 214 that is mounted on the medial end of the receiver assembly 208 to center the receiver relative to the ear canal. Referring also to FIGS. 17 and 18, the receiver housing 212 has base 216, a cover 218, a tubular wall 220 that defines a sound tube with a sound output aperture 222 and a medial end 224, and an earpiece connector 226 that projects outwardly from the tubular wall.

A bushing 138 for the wax guard 140 may be secured to the medial end of the receiver housing 212 and, in particular, at the medial end 224 of the tubular wall 220. To that end, and referring to FIGS. 18 and 19, the medial end 224 of the tubular wall 220 includes a counterbore 226 located around the sound output aperture 222. The counterbore 226 includes an abutment surface 228 and a side surface 230 that extends from the abutment surface to the medial end 224. The bushing flange 150 may be located within the counterbore 226, while the bushing tube 146 may be located within the sound output aperture 222. As is described in greater detail above in the context of the counterbore 132, the respective sizes of the bushing 138 and the counterbore 226 may be such that the thickness of the bushing flange 150 is less than (as shown), equal to or slightly greater than the counterbore thickness. Adhesive 154 between the counterbore abutment surface 230 and the bushing flange 150 permanently connects the bushing 138 to the housing 212. Additionally, as the flange outer diameter is less than the counterbore diameter in the illustrated implementation, the small remaining gap may be filled with additional adhesive 154'. Adhesive may also be provided in the manner illustrated in FIG. 10A.

Figure 19:
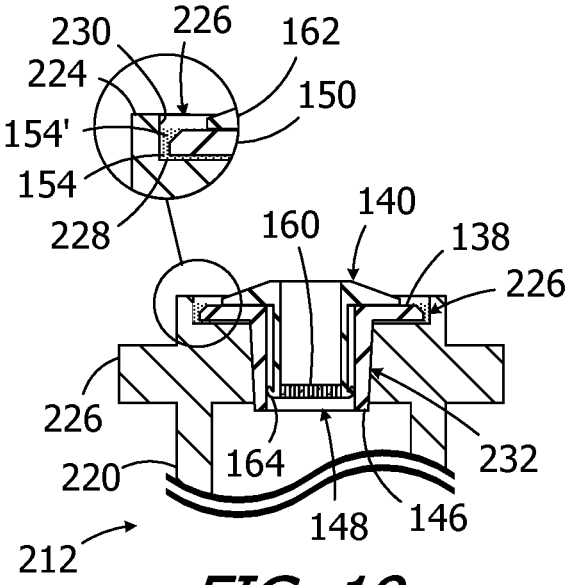
FIG. 19 is a section view of a portion of the hearing device illustrated in FIG. 16.

The wax guard 140 may be secured to the housing by way of the bushing 138 in, for example, the manner illustrated in FIG. 19. Here too, the wax guard 140 may be pushed into the bushing lumen 148. The outer diameter of the wax guard projection 164 is slightly greater than the inner diameter of the bushing lumen 148. As a result, the wax guard projection 164 will create an interference fit that secures the wax guard 140 to the bushing tubular wall 146 during use, yet allows the wax guard to be removed and replaced as necessary.

Figure 20:
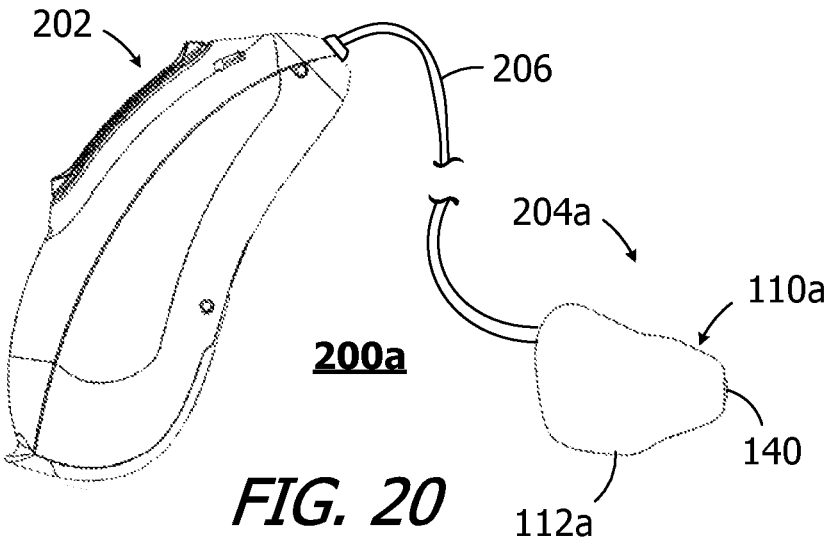
FIG. 20 is a side view of a hearing device in accordance with one embodiment of a present invention.
Figure 21:
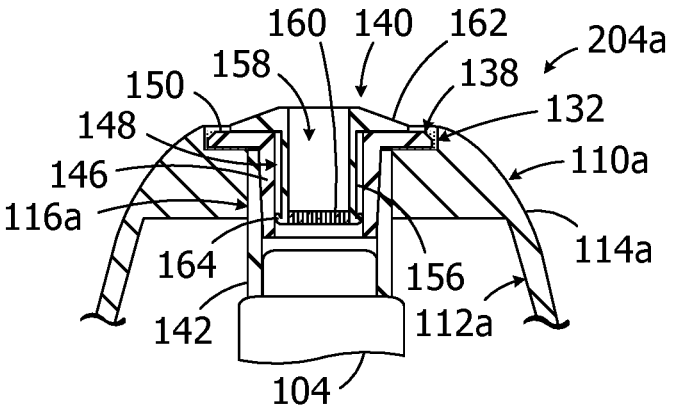
FIG. 21 is a section view of a portion of the hearing device illustrated in FIG. 20.

Another exemplary hearing device is generally represented by reference numeral 200*a* in FIGS. 20 and 21. Hearing device 200*a* is substantially similar to hearing device 200 and similar elements are represented by similar reference numerals. For example, the exemplary hearing device 200*a* includes a behind-the-ear (BTE) component 202, with one or more microphones, a sound processor, a power source and other conventional instrumentalities, and an in-the-ear (ITE) component 204*a* that delivers sound to ear canal. A cable 206 electrically connects the BTE component 202 to the ITE component 204*a*. Here, however, the ITE component 204*a* does not include a soft earpiece 214 and instead includes a relatively rigid receiver housing 110*a* in which a receiver 104 is located. The receiver housing 110*a*, which may be formed from materials such as acrylic or titanium, is sized and shaped for positioning within the ear canal, and includes a wall 112*a* with an outermost surface 114*a*, a sound output aperture 116*a*. The ITE component 204*a* also includes the above-described counterbore 132 and bushing 138 secured thereto, A wax guard 140 may be secured to the housing 110*a* by way of the bushing 138 in, for example, the manner illustrated in FIG. 21 and described in detail above with reference to FIGS. 14 and 15.

Although the inventions disclosed herein have been described in terms of the preferred embodiments above, numerous modifications and/or additions to the above-described preferred embodiments would be readily apparent to one skilled in the art. The inventions include any combination of the elements from the various species and embodiments disclosed in the specification that are not already described. It is intended that the scope of the present inventions extend to all such modifications and/or additions and that the scope of the present inventions is limited solely by the claims set forth below.

We claim:

1. An apparatus, comprising:

a hearing device housing including at least one wall with an outer surface, a sound aperture and a counterbore around the sound aperture, the counterbore defining an abutment surface and a side surface defining an inner diameter and extending from the abutment surface to an end at the wall outer surface;

a bushing, including a tube and a flange extending outwardly from the tube that defines an outer perimeter and an outer diameter that is less than the counterbore side surface inner diameter, an abutment surface, and a top surface, configured to receive a hearing device cerumen guard, the flange being located within the counterbore and the flange abutment surface being secured to the counterbore abutment surface with adhesive located between the flange abutment surface and the counterbore abutment surface; and adhesive around the outer perimeter of the bushing flange at the counterbore side surface end.

2. An apparatus as claimed in claim 1, further comprising:

adhesive coating the bushing flange top surface.

3. An apparatus as claimed in claim 1, further comprising:

a cerumen guard mounted to the bushing.

4. An apparatus as claimed in claim 1, wherein the at least one wall comprises a titanium wall.

5. An apparatus as claimed as claimed in claim 1, wherein the hearing device housing comprises an in-the-ear hearing device housing.

6. An apparatus as claimed in claim 1, wherein the hearing device housing comprises a hearing device receiver housing.

7. A hearing device, comprising:

an apparatus as claimed in claim 5; and a receiver within the in-the-ear hearing device housing and including a sound outlet operably connected to the housing sound aperture; and a microphone operably connected to the receiver.

8. A hearing device, comprising:

a microphone and a battery within a behind-the-ear hearing device housing;

an apparatus as claimed in claim 6; and a receiver within the hearing device receiver housing, the receiver being operably connected to the microphone and including a sound outlet operably connected to the housing sound aperture.

9. An apparatus, comprising:

a hearing device housing including at least one titanium wall with an outer surface, a sound aperture and a counterbore around the sound aperture, the counterbore defining an abutment surface and a side surface defining an inner diameter and extending from the abutment surface to an end at the wall outer surface; and a bushing, including a tube and a flange extending outwardly from the tube that defines an outer perimeter and an outer diameter that is less than the counterbore side surface inner diameter, an abutment surface, and a top surface, configured to receive a hearing device cerumen guard, the flange being located within the counterbore and the flange abutment surface being secured to the counterbore abutment surface with adhesive located between the flange abutment surface and the counterbore abutment surface.

10. An apparatus as claimed in claim 9, further comprising: a cerumen guard mounted to the bushing.

11. An apparatus as claimed in claim 9, wherein the hearing device housing comprises an in-the-ear hearing device housing.

12. An apparatus as claimed in claim 9, wherein the hearing device housing comprises a hearing device receiver housing.

* * * * *